US005845654A

United States Patent [19]

Johnson

[11] Patent Number: 5,845,654

[45] Date of Patent: Dec. 8, 1998

[54] METHOD AND APPARATUS FOR STYLING HAIR

[76] Inventor: Mavis J. Johnson, P. O. Box 881761, San Francisco, Calif. 94188

[21] Appl. No.: 932,453

[22] Filed: Sep. 18, 1997

Related U.S. Application Data

[63] Continuation-in-part of Ser. No. 556,460, Nov. 15, 1995, abandoned.

[51] Int. Cl.[6] ..... A45D 7/00

[52] U.S. Cl. ..... 132/210; 132/212; 132/200; 2/174; 2/181; 604/378; 34/339

[58] Field of Search ..... 132/200, 210, 132/213, 270, 274, 212, 319; 2/181, 174, 183, DIG. 11; 604/378, 370, 312; 34/339, 95; 602/45, 64, 74

[56] References Cited

U.S. PATENT DOCUMENTS 4,540,414 9/1985 Wishman ..... 604/378

5,432,091 7/1995 Lange ..... 2/181

FOREIGN PATENT DOCUMENTS 215307 10/1924 United Kingdom ..... 132/274

*Primary Examiner*—Gene Mancene
*Assistant Examiner*—Pedro Philogene
*Attorney, Agent, or Firm*—Bruce H. Johnsonbaugh

[57] ABSTRACT

A hair wrap strip is provided for styling a person's hair having an elongated, porous band of absorbent multi-layered material of sufficient length to extend around the person's head at the hair line. The band is stretched and an adhesive tab carried at one end of the band is connected to the other end of the band. The band is applied after the hair has been shampooed and had a styling gel and/or setting lotion applied but before the hair is dried. The use of this apparatus facilitates a method for straightening hair by using the elongated, porous band. The use of the band results in minimum fly-away hair and with a maximum degree of straightening the hair.

5 Claims, 1 Drawing Sheet

METHOD AND APPARATUS FOR STYLING HAIR

CROSS-REFERENCE TO RELATED APPLICATION

This application is a continuation-in-part of application Ser. No. 08/556,460 filed Nov. 15, 1995 now abandoned.

BACKGROUND AND SUMMARY OF THE INVENTION

The present invention pertains to a method and apparatus for styling hair. More particularly, the present invention relates to hair styling wherein the user seeks to have his or her hair straightened. The present invention is particularly useful for some ethnic hair styles wherein the hair is sought to be straightened and a secondary goal is to avoid fly-away hair strands.

The prior art includes various methods and apparatus for accomplishing the straightening of hair while minimizing the fly-away strands. The prior art includes the use of various gels and/or setting lotions which are applied to the hair after the hair is shampooed; after which the hair is combed and then dried. A primary disadvantage with the prior art techniques has been the presence of fly-away hair, i.e., hair that curls and separates from the straightened hair. The prior art has attempted to minimize fly-away hair by applying paper strips to the edges of the hair before the hair is dried. The paper strips typically used in the prior art are conventional "neck strips" commonly used by barbers to prevent hair from falling into the shirt or blouse of the person receiving a haircut. These "neck strips" are deficient in several respects when used in hair styling. First, although the neck strips are long enough to wrap around a person's neck, they are not long enough to extend around a person's head without being stretched. Secondly, the ordinary "neck strips" are single layered, and tend to break apart if exposed to excessive moisture and/or heat. Thirdly, the ordinary "neck strip" does not have a fastener which is capable of holding the strip in place around a user's hair and which is acceptable for use with a hair dryer. Fourth, when using the common "neck strip" in hair styling, since the neck strip is single layered, it will only sustain a minimum amount of stretching without breaking.

According to the present invention, a hair wrap strip is provided which overcomes the problems presented in using an ordinary "neck strip" for styling hair. Specifically, the hair wrap strip of the present invention is a multi-layered porous band of sufficient length to wrap completely around the user's head. The present invention also includes a degree of resilience to allow the band to be stretched to more tightly hold the user's hair in place. The present invention also provides a convenient and easily used connecting tab to hold the band in place for the drying process.

A primary object of the invention is to provide a porous hair wrap strip which holds the user's hair firmly in position during the drying process and allows the free flow of air therethrough to accomplish hair styling and/or straightening while minimizing fly-away hair.

Another object of the invention is to provide a simple, inexpensive and rugged hair wrap strip capable of holding a user's hair in position with the hair saturated with styling gel and/or setting lotions and which remains in position through the drying process.

Another object of the invention is to provide a inexpensive and reliable method for styling and/or straightening hair in which the hair is held firmly and securely in position during the drying process.

Other objects and advantages of the invention will become apparent from the following description of the drawings wherein:

DETAILED DESCRIPTION OF THE DRAWINGS

Figure 1:
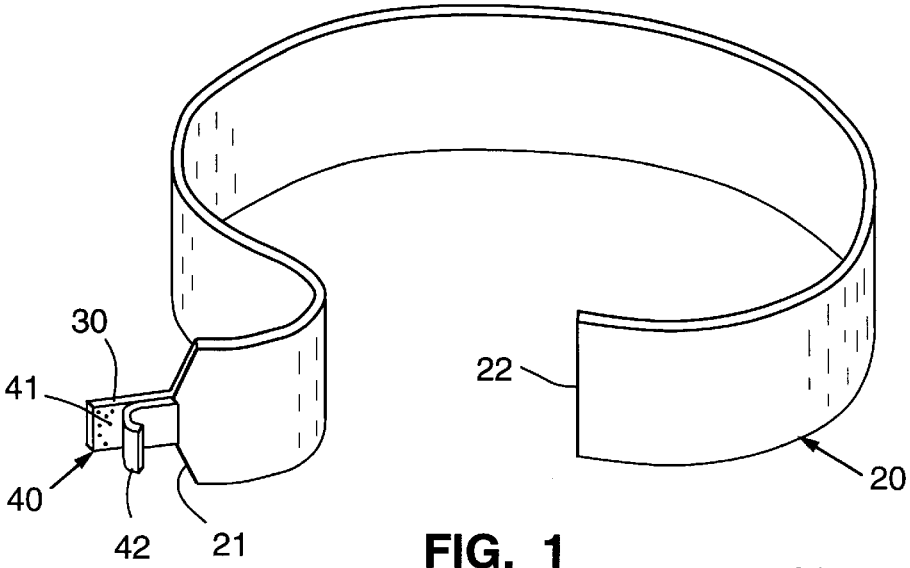
FIG. 1 is a perspective view of the hair wrap strip according to the present invention.
Figure 1A:
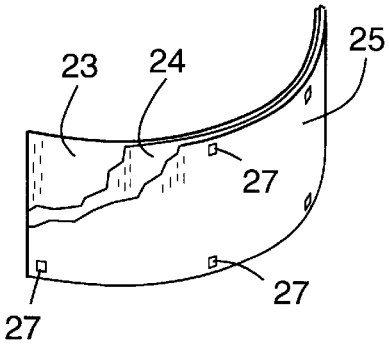
FIG. 1A is a perspective view showing a portion of the hair wrap strip of FIG. 1 in a partially breakaway view to show the multiple layers of material.

As shown in FIG. 1, an elongated band shown generally as 20 is provided having a first end 21 and a second end 22. The length of band 20 is sufficient to extend around a user's head along the edge of the hair line as shown generally in FIGS. 2 and 3. For example, the band may be 24½ inches long and approximately 2⅝th inches wide. The preferred variation of the strip utilizes three separate layers 23, 24 and 25 shown best in FIG. 1A. The use of multiple layers provides several distinct advantages over the use of a single, thin layer. The use of multiple layers allows the inner layer, closest to the user's scalp, to absorb most of the moisture while the outer layers remain dry and of sufficient strength to hold the hair in place. It is simply unacceptable for the band 20 to break apart or to otherwise become separated from the person's hair during the drying process, which causes the presence of unacceptable fly-away hair in the finished hair style. The three layers 23, 24 and 25 may be held together by adhesive spots 27. The three layers may all be of the same or different materials. The layer 23 contacting the hair should be absorbent, while the outer layer 25 should be a strong material to hold band 20 firmly in place without breaking. All three layers are porous to allow air to pass freely therethrough. Two layers of material will also function, but three layers are preferred. More than three layers will also function, as long as air can freely flow therethrough.

A tab 30 is carried by the first end 21 of the strip or band 20. Connecting means 40 is carried by tab 30 for connecting the first end 21 of the elongated band 20 to the second end portion 22. In the variation shown in the drawings, connecting means 40 includes a pressure sensitive layer of adhesive 41 applied to tab 30 and a release strip 42 which is removed prior to application of the band 20 to a person's hair.

Figure 2:
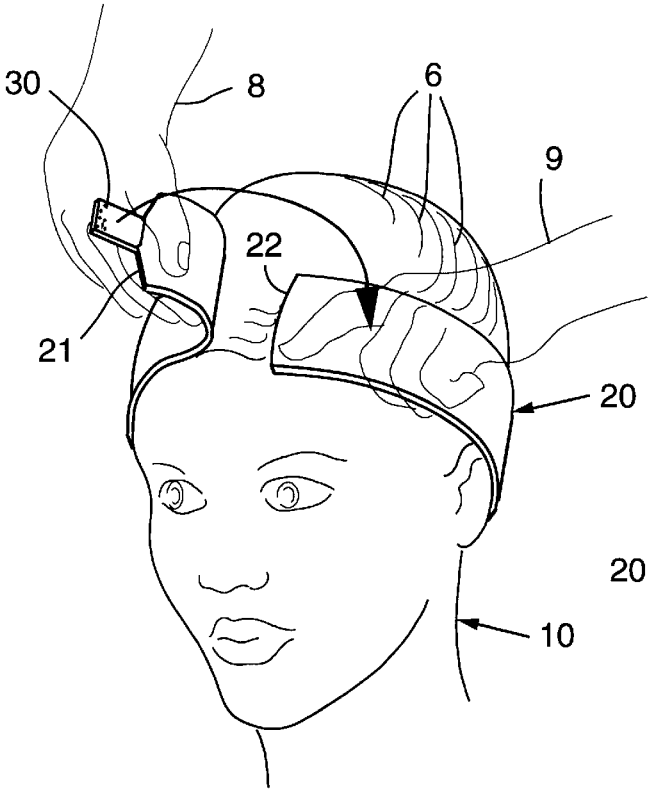
FIG. 2 is a perspective view showing the hair wrap strip being applied to a person's hair by a second person.
Figure 3:
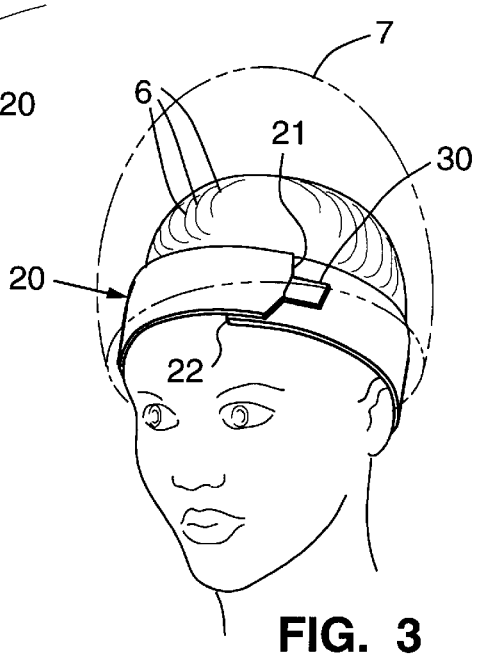
FIG. 3 is a perspective view showing the hair wrap strip of the present invention in place as the person's hair is being dried.

As shown in FIGS. 2 and 3, the person 10, who may be either female or male, is having the band 20 applied by a second person whose hands are shown as 8 and 9. Although FIG. 2 shows the band being applied by a second person, the band of the present invention may be applied by the user. FIG. 2 shows the left hand 9 holding the second end 22 of band 20 firmly against the scalp of the person 10 while the first end 21 of band 20 is being stretched and then pressed into position on second end 22 as shown in FIG. 3. Tab 30 is simply pressed onto band 20 near the second end 22 and is held in place by the adhesive. As shown in FIG. 3, the person's hair is securely held in position against the skull by band 20 as the hair is being dried by a commercial drying bonnet 7.

The method of using the band will now be briefly described. The person's hair is first shampooed and a commercially available styling gel and/or setting lotion applied to the hair. The hair is then combed into the desired position, which in the case of some ethnic hair styles, is in a tight circular pattern shown by the lines 6 in FIGS. 2 and 3. The next step is to apply the elongated multi-layered resilient, porous and absorbent band taught by the present invention around the person's head along the lower edge of the person's hair. The band is then stretched as shown best in FIG. 2 and the ends of the band are connected together. The hair is then dried and finally the band is removed. The hair under the band dries as fast as hair not under the band.

The preferred material for use in forming all three layers 23, 24 and 25 of the band 20 is the same type of material used in commercially available neck strips. One example of the material is currently sold by Kimberly Clark Corporation under its registered trademark SANEK. These neck strips are stretchable, absorbent and porous paper having relatively high cotton content. Alternatively, the outer layer 25 may be a porous cotton cloth material of considerably greater strength than a neck strip. The assembled elongated band is, therefore, free of any impervious layers which would prevent the flow of air therethrough. Each layer of the elongated band is heat tolerant. The use of other specialty tissues possessing these characteristics are also a possibility.

It should be noted that a chemical relaxer is often, but not always, applied before shampooing to some ethnic hair textures once every 4–6 weeks as a preliminary step in the straightening of hair.

The connecting means may be of various design including plastic clips. Metallic clips would also work but may become dangerously hot during the drying process and are definitely not preferred. The use of buttons or snaps are other workable alternatives, although the preferred connecting means is pressure sensitive adhesive strip.

What is claimed is:

1. A hair wrap strip used in styling a person's hair, wherein said hair wrap strip is applied to said person's hair prior to drying, said hair wrap strip comprising:

an elongated band means of absorbent, porous, multi-layered material of sufficient length to extend around said person's head along the edge of the hairline, said elongated band means being free of any impervious or fused layers which would prevent or restrict the flow of air therethrough, said elongated band means having first and second ends, and wherein said elongated band means covers the hair along the hairline to prevent fly-away hair during drying but also allows heated air to flow through and dry the hair under said elongated band means, and connecting means for connecting said first end of said elongated band means to said second end of said elongated band means.

2. The apparatus of claim 1 wherein said elongated band is made of resilient paper and comprises three or more layers.

3. The apparatus of claim 1 wherein said connecting means comprises pressure sensitive adhesive.

4. The apparatus of claim 1 wherein said elongated band comprises an inner layer made of paper and an outer layer made of cloth.

5. A method for styling a person's hair comprising the steps:

shampooing said person's hair, applying gel and/or setting lotions to the hair, combing the hair, applying an elongated, porous, multi-layered, resilient and absorbent band having first and second ends around said person's head, said band being free of any impervious or fused layer which would prevent or restrict the flow of air therethrough, stretching said elongated band and connecting said first and second ends together, drying the hair, wherein said porous band allows drying air to flow freely therethrough and hair under said band is dried at the same time as hair not under said band, and removing said elongated band.

* * * * *